US007750820B1

(12) United States Patent
Ford

(10) Patent No.: US 7,750,820 B1
(45) Date of Patent: Jul. 6, 2010

(54) CHRISTMAS TREE ALERTING DEVICE

(76) Inventor: Travis C. Ford, 8275 Muscat Ct., Redding, CA (US) 96001

( * ) Notice: Subject to any disclaimer, the term of this patent is extended or adjusted under 35 U.S.C. 154(b) by 398 days.

(21) Appl. No.: 11/713,396

(22) Filed: Mar. 2, 2007

(51) Int. Cl.
*G08B 23/00* (2006.01)

(52) U.S. Cl. ..... 340/693.5; 340/577; 340/628; 340/693.9

(58) Field of Classification Search ..... 340/577, 340/628, 693.5, 693.6, 693.9
See application file for complete search history.

(56) References Cited

U.S. PATENT DOCUMENTS 4,075,614 A * 2/1978 White ..... 340/693.5
4,623,878 A * 11/1986 Schoenwetter ..... 340/628
5,821,865 A * 10/1998 Solak ..... 340/628
6,382,582 B1 * 5/2002 Brown ..... 340/618
2007/0063857 A1 * 3/2007 Kisner et al. ..... 340/628

* cited by examiner

*Primary Examiner*—Thomas J Mullen
(74) *Attorney, Agent, or Firm*—Theodore J. Bielen, Jr.

(57) ABSTRACT

An emergency alerting device for a Christmas tree utilizing a sheath having a housing forming an open chamber which is capable of encompassing the top of a Christmas tree. The decorative element is connected to the sheath and includes a smoke detector mounting to the surface of the decorative element. An alarm receives a signal from the smoke detector which sets off a perceivable audio noise. A source of power linked to the audio alarm activates the auto alarm.

6 Claims, 2 Drawing Sheets

CHRISTMAS TREE ALERTING DEVICE

BACKGROUND OF THE INVENTION

The present invention relates to a novel and useful emergency alerting device for use with a Christmas tree.

The traditional Christmas tree is normally placed in a home to celebrate yearend festivities. Although Christmas trees are by that term the display tradition precedes the advent of Christianity.

In most cases, a Christmas tree is cut in a forest and shipped to populated areas weeks before the tree is erected in home. Thus, the Christmas tree is in a decaying state when decorated. In many cases, the Christmas tree is also dry and is considered to be a prime fire hazard in the home at this time of year. Placing water at the base of the tree in a pot and in contact with the trunk of the tree aids a little in preventing the drying of the tree. However, Christmas trees are highly inflammable. Consequently, most cultures do not use open candles in conjunction with a Christmas tree. Despite this prohibition, Christmas trees are often ignited by electrical malfunctions associated with electrical lights that are normally strung around a Christmas tree.

An emergency alerting device for a Christmas tree which would warn the occupants of a dwelling of a fire in the vicinity of the Christmas tree would be a notable advance in the field of home safety.

BRIEF SUMMARY OF THE INVENTION

In accordance with the present invention a novel and useful emergency alerting device for a Christmas tree is described hereinbelow.

The emergency alerting device of the present invention utilizes a sheath which includes a housing. The housing possesses an open chamber with an entrance or opening to the same. The open chamber is sized to at least partially encompass the top portion of the Christmas tree, which is typically narrower than the bottom of the Christmas tree. In other words, the sheath is placed over the top of the Christmas tree and is immediately held in this position. In this regard, the housing is normally cone shaped.

The sheath may be formed to hold a weight which maintains the sheath in its desired position such that the smaller portion of the sheath, which may be the tip of the cone, is oriented upwardly.

In addition, a filler material which is compressible and resilient may be positioned within the open chamber of the sheath. In this manner, the tips of the Christmas tree top lying within the open chamber of the sheath interact with such material to prevent the shifting of the sheath relative to the top of the tree.

In addition, the device of the present invention utilizes a decorative element which is connected to the sheath. The decorative element extents upwardly from the sheath when the sheath is placed over the top of the tree and includes a surface. A smoke detector and/or flame detector is mounted to the surface of the decorative element and is capable of generating an alarm signal indicating the presence of smoke or flame, as the case may be. An audio alarm is activated by the signal from the smoke detector/flame detector. A source of power, such as a battery, is linked to the audio alarm to produce an audio signal.

It may be apparent that a novel and useful emergency alerting device for a Christmas tree has been hereinabove described.

It is therefore an object of the present invention to provide an emergency alerting device for a Christmas tree which detects the presence of smoke or flame in the vicinity of the Christmas tree and generates an audio alarm.

Another object of the present invention is to provide an emergency alerting device for a Christmas tree which fits over the top of the Christmas tree and maintains itself in an upright position.

Yet another object of the present invention is provide an emergency alerting device for a Christmas tree which is easily installed on a Christmas tree and provides smoke and flame detection.

The invention possesses other objects and advantages especially as concerns particular characteristic thereof which will become apparent as the specification continues.

Figure 1:
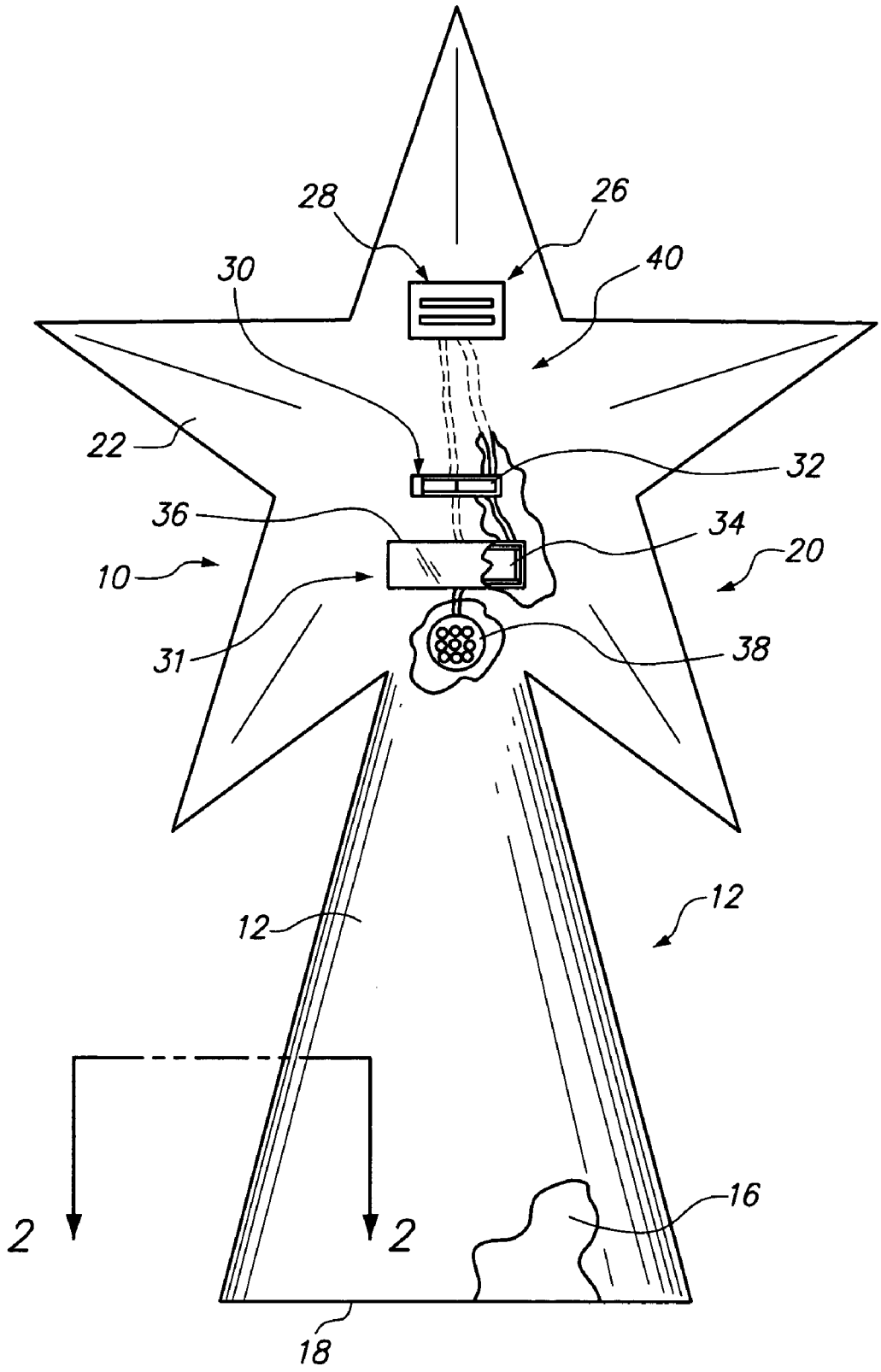
FIG. 1 is a rear elevational view of the device of the present invention.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

An embodiment of the invention as a whole is depicted in the drawing by reference character 10. Alerting device 10 includes as one of the elements a sheath 12 which may be formed in the shape of a truncated cone. Sheath 12 includes a housing 14 having an open chamber 16 which is entered through opening 18. Opening 18 is intended to fit over the top of a Christmas tree which will be discussed hereinafter.

Device 10 also includes a decorative element 20, which is shown in FIG. 1, in a form of a star. Element 20 includes a back surface 22, FIG. 1 and a front surface 24 which does not include any interruptions. Of course, decorative element 20 may take the form of other symbols such as angels, Santa Clauses, reindeer, snowmen, snowflakes and the like. Decorative element 20 may be attached to sheath 12 or molded as a unitary item, as is depicted in FIG. 1.

Device 10 also includes a smoke and fire detector 26 which may be of conventional configuration. Smoke and fire detector 26 is mounted in decorative element 20 and includes apertures or slots 28 in order to communicate with the air surrounding device 10. Smoke and fire detector 26 is capable of generating a signal indicating the presence of smoke or flame in the vicinity of device 10.

Switch 30 is capable of activating and deactivating smoke and fire detector 26 and includes actuator 32 which is available for use on the exterior of surface 22 of decorative element 20.

A source of power 31, which may be in a form of a battery pack, may be employed to provide electrical energy to smoke and fire detector 26 if detector 26 does not have a self-contained power supply. Battery pack 31 also includes a battery 34 which is removable therefrom by the unlatching of detachable cover 36 of battery pack 31. A speaker 38 emits an audio signal when a signal is generated by detector 26. Battery pack 31 may also power speaker 38 independently of a power signal from detector 26. In any case, an appropriate plurality of conduits 40 is depicted in the drawing schematically in solid and in phantom rendition to indicate a typical interaction between detector 26, switch 30, source of power 31, and speaker 38.

Figure 2:
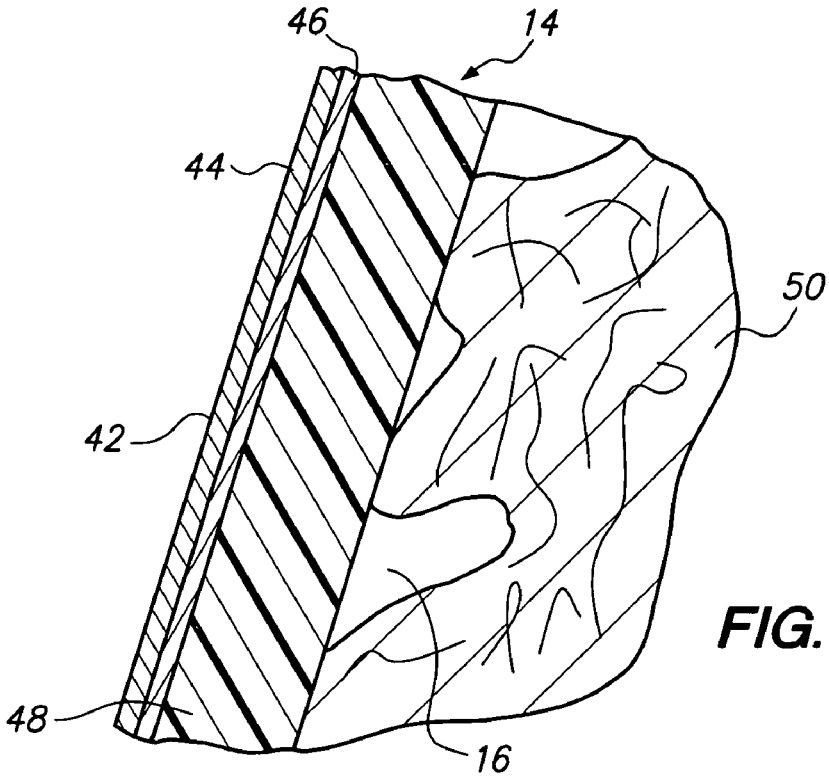
FIG. 2 is a sectional view taken along line 2-2 of FIG. 1.

Turning to FIG. 2, it may be observed that housing 14 is shown in section in which surface 42 of housing 14 may possess an esthetic appearance. Surface 42 may be composed of fabric or like material as indicated by fabric layer 44. Fabric layer 44 has an optional weighted layer 46, which may be metallic, in order to provide sheath 12 with the weight in excess of that of decorative element 20. It is believed that weight layer 46 stabilizes device 10 to a high degree. In addition, a filler 48 maybe employed in device 10 of the present invention. Filler 48 may include a compressive resiliant material such as a polymeric or elastomeric type material. Christmas tree fronds 50 are easily held by filler layer 48 to again stabilize device 10 when in use.

Figure 3:
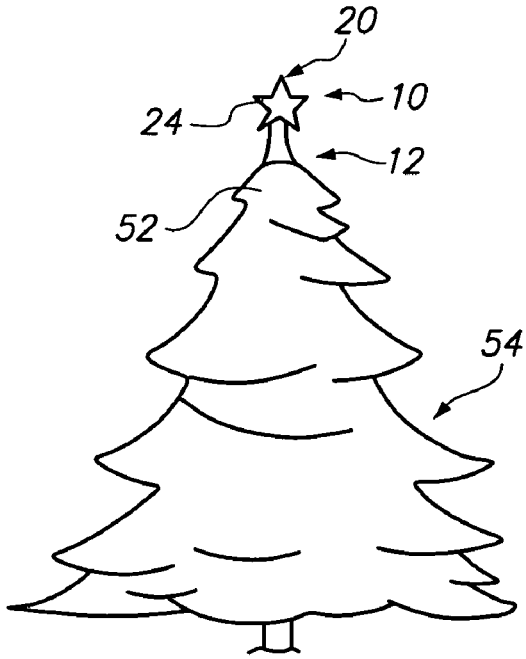
FIG. 3 is a front elevational view of a Christmas tree in which the device of the present invention is in place on the top thereof.

In operation, the user places a device 10 over the top portion 52 of Christmas tree 54, FIG. 3. Decorative fabric layer 44 will appear to persons around tree 54 while weight layer 46 and filler 48 stabilize device 10 at the top portion of 52 of Christmas tree 54. Switch 30 is then turned to the "on" position to allow detector 26 to indicate the presence of smoke or flame around tree 54, as the case maybe. Should this occur, a signal will be sent from detector 26 to speaker 30 which will then sound an alarm. Power source 31 powers detector 26 and speaker 38 in this regard.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An emergency alerting device for a Christmas tree having narrowed top portion, comprising:

a. a sheath, said sheath having a housing, said housing including an open chamber with an opening thereto, said open chamber at least partially encompassing the top portion of the Christmas tree, said opening permitting the Christmas tree to enter said open chamber;

b. a decorative element, said decorative element being connected to said sheath, said decorative element having a surface;

c. a smoke detector, said smoke detector being mounted to said surface of said decorative element, said smoke detector generating a signal indicating the presence of smoke;

d. an audio alarm, said audio alarm being activated by said signal indicating the presence of smoke, from said smoke detector;

e. a source of power, said source of power being linked to said audio alarm to enable said audio alarm to produce an audio sound when said audio alarm is activated by said signal; and f. a filler of compressible, resilient material, said filler positioned within said open chamber of said sheath.

2. The device of claim 1 in which said sheath is cone-shaped.

3. The device of claim 1 which additionally comprises a weight held by said sheath.

4. The device of claim 1 which further comprises a flame detector, said flame detector being linked to said decorative element, said flame detector generating a signal indicating the presence of a flame, said audio alarm being activated upon receipt of said signal indicating the presence of a flame.

5. The device of claim 4 in which said sheath is cone-shaped.

6. The device of claim 4 which additionally comprises a weight held by said sheath.

* * * * *